United States Patent [19]

Moyle et al.

[11] 4,013,540

[45] Mar. 22, 1977

[54] PETROLEUM PITCH PREPARATION

[75] Inventors: Maurice Moyle, Oakville; Buenanventura B. Galvez, Islington; Eric C. Pease, Campbellville; Alan Logan, Oakville, all of Canada

[73] Assignee: Gulf Oil Canada Limited, Toronto, Canada

[22] Filed: Mar. 10, 1975

[21] Appl. No.: 556,831

[52] U.S. Cl. ..... 208/4; 208/5; 208/6

[51] Int. Cl.[2] ..... C10C 3/04

[58] Field of Search ..... 208/4, 5, 6

[56] References Cited

UNITED STATES PATENTS

| | | | |
|---|---|---|---|
| 237,662 | 2/1881 | De Smedt | 208/4 |
| 2,029,504 | 2/1936 | Ragatz | 208/4 |
| 2,046,081 | 6/1936 | McNeil | 208/4 |
| 3,238,116 | 3/1966 | Hamner et al. | 208/6 |
| 3,725,240 | 4/1973 | Baum | 208/4 |
| 3,923,633 | 12/1975 | Senolt et al. | 208/6 |

*Primary Examiner*—Veronica O'Keefe
*Attorney, Agent, or Firm*—D. R. Morrison

[57] ABSTRACT

A process having a specified sequence of steps for preparing a petroleum pitch binder suitable for electrodes used in smelting aluminum is disclosed, in which a decant oil petroleum fraction is oxy-activated under specified conditions of temperature, pressure, and time, then heat treated under other specified conditions, and finally distilled under specified conditions to form a petroleum pitch having desired properties.

7 Claims, No Drawings

PETROLEUM PITCH PREPARATION

This invention relates to the preparation of a petroleum pitch, and more particularly to a process for the conversion of a heavy clarified bottoms fraction of a catalytic gas oil cracking operation to a petroleum pitch acceptable to the aluminum industry as an electrode binder.

Numerous processes have been described in the literature for the preparation of petroleum pitches which have been proposed as substitutes for coal tar pitch in the aluminum smelting industry but, despite the increasing cost and shortage of coal tar pitch, much of the aluminum smelting industry has made little or no use of these previously proposed petroleum pitches as a binder for the electrodes used in aluminum smelting pots. Failure of petroleum pitch to achieve recognition as an acceptable binder in this use appears to be particularly incongruous when the material to be bound by the binder in electrodes for aluminum smelting is another petroleum product, petroleum coke. Basic to the problem of substituting petroleum pitch for coal tar pitch as an electrode binder are the poorly defined and variable natures of the chemical compositions or constitutions of both materials and of the materials from which they are derived. As a consequence, the tests used to assess the suitability of materials as binders for electrodes are largely empirical and a final determination of the suitability of a material as an electrode binder for aluminum smelting can only be made by trial in a full scale operating aluminum potline.

However, despite the empirical nature of much of the assessment of petroleum pitch as a binder for electrodes, certain essential or highly desirable properties of such binders are known and, to the extent that they can be determined and compared, it is necessary or advantageous to optimize them. Thus the softening point of a pitch can readily be measured and varied by appropriate variations in the steps used in preparation of the pitch. Softening point of a petroleum pitch thus can be optimized to satisfy the particular temperature requirements for pitch that is appropriately fluid at the temperature of mixing with the coke and any other material to be bound thereby, and is solid at the temperatures at which the electrodes formed therewith must subsequently be manipulated. Throughout this specification and claims, the softening point referred to is that determined by ASTM D36 (Ring and Ball) Method. Another more empirical assessment made on binder pitch is the so-called "beta resin" content, or content of material insoluble in benzene but soluble in quinoline, as determined by successive extractions of pitch samples with these solvent materials. "Beta resins" are believed to be desirable ingredients in electrode binder pitches, hence it is desirable to optimize the proportion of these materials in pitches when preparing the latter as electrode binders. However, determination of the proportion generally is a time consuming operation involving prolonged solvent extractions, hence beta resin content generally is not a suitable parameter for purposes of process control, particularly for continuous processes. Likewise another empirical assessment is the coking value, which is an indication of the proportion of the pitch which will remain in the electrode as carbon after the electrode is baked. However coking value determinations, done in the conventional manner for all carbonaceous materials, are also time consuming and hence they are not suitable for process control.

In the prior art the processes used in efforts to prepare acceptable electrode binder pitch from the heavy clarified bottoms fraction of a catalytic gas oil cracking operation, commonly known as decant oil, have involved (1) heat treatment to induce cracking and other reactions which improved the properties of the products for use as electrode binder, and (2) oxidation by blowing heated decant oil with gas containing free oxygen, again to induce reactions which improved the properties of the products for use as electrode binder. A combination of the thermal treatment followed by the oxidation process has also been suggested but the conditions heretofore prescribed for this sequence do not appear to have provided a product acceptable to the aluminum smelting industry as an electrode binder.

It has now been found that, with a preferred sequence of thermal treatment steps under specified conditions hereinafter set out, the first of which steps includes an activation with free oxygen, most conveniently as air (oxy-activation), it is possible to prepare, from a full range decant oil having a boiling range at atmospheric pressure at least 95% of which is above 450° F (232° C), an electrode binder pitch which meets the requirements of the aluminum smelting industry. The invention thus consists in a process for the preparation of a petroleum pitch binder for the manufacture of carbon electrodes, comprising (1) subjecting a full range decant oil petroleum fraction, obtained as the clarified bottoms fraction of a catalytic gas oil cracking operation and having a boiling range at atmospheric pressure at least 95% of which is above 450° F (232° C), to oxy-activated condensation by heating at a temperature in the range from 400° to 500° F (204° to 260° C) under a pressure in the range from atmospheric to four atmospheres and with the addition of air introduced to the fraction for a period of from one to 24 hours, preferably in a proportion of at least 50 liters of air per hour per kilogram of fraction especially if no mechanical agitation is used to assist dispersion of the air in the fraction, (2) thereafter heating the resulting material for a period of from 3 to 300 minutes at a temperature in the range from 775° to 975° F (412° to 524° C) under a pressure of from 15 to 30 atmospheres, and finally (3) flash distilling the heated material to separate therefrom that portion thereof which must be removed to leave the remainder as a petroleum pitch with a softening point in the range from 175° to 275° F (70° to 135° C). Throughout this specification and claims, any percentages expressed are percentage by weight unless otherwise specifically indicated.

It was previously indicated herein that the compositions of decant oils vary over a wide range. As readily determined by gradient elution chromatography, i.e. by the adsorption of samples on a chromatographic column followed by the elution of discrete fractions by selected solvents, components of decant oil include saturates (normal-, iso-, and cyclo-paraffins), aromatics (alkyl benzenes, benzo- cyclo-paraffins, and polynuclear aromatics including alkyl- and cycloalkyl substituted ones), and polars (primarily heterocyclic nitrogen or oxygen containing aromatics); sulfur compounds in decant oil are mostly included with the aromatics in such determinations, which are based on modifications of the ASTM D2007 procedure. The desirable beta resins in electrode binder pitch are known to be highly aromatic in character, hence the aromatics content of decant oils can be expected to contribute greatly to the formation of beta resins in the preparation of electrode pitch from decant oil. However, the saturates content of decant oils has not been expected to contribute significantly to the formation of useful components of highly aromatic electrode binder pitch. For this reason it has been the frequent practice, in trying to prepare acceptable electrode binder pitches from decant oils, to extract the bulk of the saturates from the oils and to prepare pitch from extracted decant oils which, by virtue of the removal of saturates therefrom, have a much higher proportion of aromatics in their composition. It has also been stated in the art that, when treating a decant oil with oxygen at elevated temperatures to make an electrode binder pitch, it is essential that the decant oil be an extracted material having the bulk of the saturates removed by the extraction. Obviously the additional extraction step increases the cost of producing electrode binder pitch from decant oil and reduces the yield of pitch potentially obtainable from the decant oil by removal of material that could otherwise benefically appear in the pitch. Thus it is completely unexpected that a full range (unextracted) decant oil can be converted into an acceptable electrode binder pitch by a method which starts by treating such decant oil with oxygen at elevated temperature.

As previously indicated herein, the present invention requires a specific sequence of three essential steps, viz: (1) heating of a full range decant oil to a temperature in the range 400° to 500° F (204° to 260° C) with addition of air thereto under a pressure in the range from atmospheric to four atmospheres for a period of one to 24 hours, the proportion of air preferably being at least 50 liters of air at room temperature and atmospheric pressure per hour per kilogram of decant oil, especially if no mechanical agitation is used to assist dispersion of the air in the fraction, these conditions being as previously specified herein and causing oxy-activated condensation to take place among the ingredients in the decant oil; (2) subsequently heating the resultant material under more severe conditions of temperature and pressure as previously specified herein; finally (3) flash distilling the more volatile portion of the heat treated material whereby the residual non-volatilized material has a softening point in the range from 175° to 275° F, (79° to 135° C).

The first step in the process of the invention is advantageously carried out under some pressure, although the pressure does not have to be high; adequate and preferred pressures are from two to four atmospheres above atmospheric; substantially three atmospheres pressure is a particularly convenient value. Pressure operation is found to be of particular importance in obtaining yields of pitch product significantly and unexpectedly superior to yields obtained operating at atmospheric pressure. Of assistance in improving the rate of reaction is the provision of mechanical agitation such as stirring during addition of air to the decant oil, the agitation being an aid to better dispersion of air and consequent activation of the reactions which occur. Although the oxygen in the air used is known to be essential to the activation of the reactions which take place, analysis of the gases vented from the first step of the process shows that only a relatively small proportion of the oxygen in the air fed to the process is consumed, hence it is clear that the reactions taking place, although oxy-activated, are not all simple oxygen consuming reactions. They are believed to be primarily condensation reactions in which higher molecular weight compounds are formed by condensation of two or more lower molecular weight compounds under the activation of oxygen at the elevated temperature prevailing. The oxygen is believed to promote the condensation reactions by acting as a hydrogen scavenger, forming water as byproduct. When mechanical agitation is not used as an aid to dispersing air in the oil, higher proportions of air can be used and are preferred to improve the dispersion by creating greater turbulence during passage through the oil, for example 500 liters per hour per kilogram of oil. When mechanical agitation is used, lower proportions of air may be used, for example less than 100 liters per hour per kilogram of oil. Care must be taken however, to ensure that air is not dispersed into oil at a temperature so high that uncontrolled or runaway exothermic oxidation reaction develops. For this reason the temperature during the oxy-activation must be monitored and controlled within the specified range. The oxy-activation can be carried out as a batch or a continuous operation, care being taken in either case to ensure sufficient time for the oxy-activated reactions to occur in the chosen equipment at the desired temperature selected from the specified range. The continuance of the oxy-activated condensation for a period of from one to 24 hours causes an increase in the softening point of the decant oil, and the condensation is continued only until the softening point of material has risen to a value in the range from 120° to 180° F (49° to 82° C), preferably 150° to 170° F (66° to 77° C); the extent to which the softening point is caused to rise should be coordinated with the duration and severity of the heating step to which the material is subsequently subjected, so that formation and deposition of coke during the latter step is avoided while achieving the softening point required for the final product.

The second step in the process of the invention requires heating of the oxy-activated material to a much higher temperature than used in the first step, specifically from 775° to 975° F (413° to 524° C), preferably in the range 850° to 950° F (454° to 510° C), most preferably in the range 875° to 925° F (468° to 496° C) and under pressure of from 15 to 30 atmospheres. Again care must be taken to ensure allowance of sufficient time for the reactions to proceed at the selected temperature, e.g. at least three minutes at the highest temperature mentioned, but they must not be allowed to proceed too long, e.g. not over substantially 15 minutes at substantially 900° F (482° C) or over 300 minutes at substantially 800° F (427° C); at such high temperatures formation of coke-like material in the oil begins and deposition of coke on reactor walls develops, hence the duration of subjection to these temperatures should be controlled carefully. The pressure is necessary to ensure that the material remains substantially all in the liquid phase during this step. The heating step can be carried out as either a batch or continuous flow operation. Continuous flow operation is preferred as, among other things, it is more efficient in time utilization, especially when short reaction times are involved; also it provides the easiest means to maintain agitation to ensure optimum extent of the desired reactions which occur at the elevated temperature. Furthermore, continuous flow operations are preferably carried out under conditions of turbulent flow rather than laminar flow, as the former minimizes coke formation and helps maintain in suspension any coke that is formed, thus reducing coke deposition on reactor walls; furthermore it ensures even more efficient mixing of the material and reduces the time or temperature conditions which would otherwise be required to achieve a desired degree of reaction.

In the third step of the process of the invention, sufficient of the most volatile material in the oxy-activated and heat treated oil is distilled therefrom by flash distillation at a pressure much lower than used in the previous step to leave the resulting petroleum pitch residue with a softening point in the range preferred by the user for making electrodes. Generally this is in a preferred range from 200° to 250° F (93° to 121° C). The flash distillation may even be under partial vacuum if desired.

The invention can now be more readily described by reference to the following examples which are given to illustrate the invention without limiting the scope thereof as defined in the ensuing claims.

EXAMPLE 1

The first step of the process of the invention for this example was carried out in a small electrically heated batch reaction kettle having a volume capacity of about five liters. It was equipped with necessary feed and product removal lines, an impeller type stirrer, a sparger to distribute air into the bottom of the kettle contents and a vent line with a condenser for liquid overhead products, a back pressure regulator to maintain the air pressure in the kettle at a set value, and a wet test meter to measure the volume of vented gas. A sample of a full range decant oil obtained from a catalytic cracking operation and having an initial boiling point of 490° F (255° C) and a boiling point of 1014° F (545° C) at a recovery of 83% as determined by ASTM method D1160 was charged to the kettle. The oil had an API gravity of minus 6.2, a Saybolt Universal viscosity at 210° F (99° C) of 173.3 seconds, a Coking Value of 15.9 and a BMCI (U.S. Bureau of Mines Correlation Index) of 146.2. By solubility tests it was found to contain 31.4% asphaltenes and no material insoluble in benzene. A quantity of 4367 grams of this oil was charged to the reaction kettle and heated therein to a temperature of 450° F (232° C). Then a steady stream of air at a rate of 1188 liters/hour was sparged into the oil in the kettle with the back pressure regulator set about three atmospheres, and the stirrer operating. The temperature, stirrer speed and air flow were maintained for a period of several hours, during which samples from the kettle were withdrawn periodically for measurement of the softening point of the oil, which increased as the run progressed, due to oxy-activated condensation of various components in the decant oil to form higher molecular weight materials. After eight and one-quarter hours of reaction, the residue was drained from the reactor and found to weigh 4023 grams. The liquid material condensed from the vented gases by the overhead condenser weighed 223 grams, thus the total recovery of material was 97.3%, with 2.7% being lost as gaseous material with the vented air. The yield of oxy-activated pitch intermediate was 92.2%. This material had a softening point of 163° F (73° C). A series of nine additional batches of about the same weight were similarly reacted, and the ten batches of oxy-activated pitch intermediate were composited into a single batch. The oxy-activation temperature was kept at 450° F (232° C) for all batches, and the pressure maintained around three atmospheres. A total of 42.25 kg. of the decant oil was thus processed to form the composite of 39.60 kg. of oxy-activated pitch intermediate, a yield of 93.3%. The softening point of the composite was 161° F (72° C) and by solvent extractions it was found to contain 8.8% benzene insolubles and no material insoluble in quinoline; it had a coking value of 32.6. A quantity of this pitch intermediate was then fed as a continuous stream to a tubular reactor heated to immersion in a bed of sand fluidized with a steady stream of nitrogen and with the bed maintained at a desired elevated temperature by electric resistance heaters. A preheat section of the reactor served to raise the temperature of the intermediate feed to about 900° F (482° C). During passage through the reaction zone of the tubular reactor the reacting feed was maintained at or close to the reaction temperature of 917° F (491° C) for a period of 7.5 minutes. Pressure in the reactor was maintained at 300 psig (20 atmospheres) and rate of feed of the intermediate to the reactor was 1820 grams per hour. On passing from the reactor through a pressure reducing valve the heated material was vacuum flash distilled at an absolute pressure of 635 mm Hg. at a distillation pot vapor temperature of 505° F (263° C) in an accumulator from which product was periodically drained. A product petroleum pitch was recovered having a softening point of 188° F (87° C), a coking value of 42.4, and a proportion of 21% benzene insoluble material, with little quinoline insoluble material. The pitch constituted a yield of 87.8% by weight of the intermediate fed to the tubular reactor, and thus provided an overall yield of 81% by weight of the original decant oil from which it was derived.

EXAMPLE 2

This example utilized part of the oxy-activated pitch intermediate produced in the previous example. The intermediate material was heated at a temperature of 901° F (483° C) in the continuous tubular reactor instead of 917° F, again at a pressure of 20 atmospheres, but with a feed rate averaging about 1050 grams per hour, providing a residence time in the heated zone of 12.5 minutes at the reaction temperature. The effluent product was then vacuum flash distilled as in the preceding example at an absolute pressure of 252 mm Hg. and a distillation pot vapor temperature of 460° F (238° C). A petroleum pitch product was recovered having a softening point of 199° F (93° C), a coking value of 45.9, a proportion of 25.6% benzene insoluble material, with no quinoline insoluble material. It constituted a yield of 85.6% by weight of the intermediate fed to the tubular reactor, providing an overall yield of 79.9% by weight of the original decant oil.

EXAMPLE 3

In this example the first step of the process was carried out at atmospheric pressure in an unstirred 20 liter batch upright cylindrical reaction vessel maintained at 450° F (232° C); a multi-port sparger immersed one inch (25 mm) from the bottom of the vessel served to distribute air through a charge of decant oil placed in the vessel, and a water-condenser equipped vent line served to condense volatilized liquid product from the air vented from the vessel. Three successive batches weighing 21.5 kg., 22.2 kg., and 21.1 kg. respectively were oxy-activated by heating at 450° F while a flow of 6 $ft^3$/min. (170 liters/min.) of air was sparged there-through for 4.0, 4.5, and 4.5 hrs. respectively. From the first batch there were obtained 15.5 kg. of oxy-activated pitch intermediate, i.e. a yield of 71.8%, and 4.8 kg. of liquids condensed from the off-gases; there was a loss of 1.2 kg., or 5.8% by weight of the batch. From the second and third batches there were obtained 16.3 and 15.5 kg. of oxy-activated intermediate (yields of 73.4 and 73.1%) and 5.3 and 4.8 kg. respectively of liquids condensed from the off-gases; there were losses of 0.6 and 0.9 kg. (2.6 and 4.1%) respectively from these batches. The composited batches of intermediate had a softening point of 124° F (51° C) and a coking value of 26.7, with a proportion of 5.3% of benzene insoluble material and 0.17% of quinoline insoluble material. The composited batches were then fed to the tubular reactor described in Example 1; temperature in the reactor was maintained at 947° F (508° C) and material fed under pressure of 20 atmospheres at a rate to provide a residence time of 12.7 minutes at the reaction temperature. Material leaving the reactor was vacuum flash distilled at an absolute pressure of 305 mm Hg. (12 inches Hg.) and at a distillation pot vapor temperature averaging 593° F (313° C), producing a petroleum pitch product in a yield of 87.5% for the combined second and third steps, i.e. 64% overall yield. The product had a softening point of 225° F (107° C), a coking value of 50.9%, and proportions of 29.1% of benzene insoluble material and 2.7% of quinoline insoluble material; the carbon/hydrogen ratio of the product was 1.45 and temperatures required for 10 poise and 1000 poise viscosity thereof were 370 and 255° F (188 and 124° C) respectively.

EXAMPLE 4

In this example the first step was carried out in the apparatus described in the preceding Example 3, under the same reaction conditions; again, three successive batches of decant oil were oxy-activated and the products combined into a composite, but the duration of the oxy-activation averaged ½ hour less than that of the previous example. The composite product material had a softening point of 120° F (49° C), a coking value of 26.3, and a content of benzene insoluble matter of 5.6% with no quinoline insoluble material. The composite material was fed at a pressure of 20 atmospheres to the tubular reactor described in Example 1; the temperature in the reactor was maintained at 902° F (483° C) and the material fed at an average rate of 1244 grams per hour, providing a residence time for the material at the reaction temperature of 8.2 minutes. Material leaving the reactor was fed continuously to a vacuum flash distillation where it was distilled at an absolute pressure of 100 mm Hg. (3.9 inches Hg.) with a distillation pot vapor temperature averaging 568° F (298° C). The residual petroleum pitch product which was obtained had a softening point of 194° F (90° C), a coking value of 43.1, and proportions of 15.8% of benzene insoluble material and 0.7% of quinoline insoluble material; the carbon/hydrogen ratio of the product was 1.30 and temperatures required for 10 poise and 1000 poise viscosity thereof were 290° and 194° F (143° and 90° C) respectively.

EXAMPLE 5

In this example, the first step of the process of the invention was carried out in the batch reaction kettle described in Example 1. To accumulate a quantity of material for a subsequent continuous heating step, four successive batches of decant oil were oxy-activated, each under slightly different conditions to assess the variability of some operating parameters. The oil was a full range decant oil having an initial boiling point of 464° F (240° C) and a final boiling point of 1008° F (542° C) at a recovery of 93% as determined by ASTM method D1160, an API gravity of 0.4, and a BMCI of 122. By a modified ASTM D2000 procedure, the asphaltenes content of the oil was found to be 12.2%, and no benzene insolubles were found in it. Quantities of 4.11, 4.12, 4.21, and 4.13 kg. respectively of the oil were charged to the reaction kettle, and heated to reaction temperatures of 500°, 450°, 400° and 500° F respectively (260°, 232°, 204° and 260° C) while steady streams of air at flow rates of 143, 282, 290, and 272 liters per hour per kilogram of charge respectively were sparged into the oil with the back pressure regulator set at about two and a half atmospheres. Reaction was continued for each batch until its softening point reached a value around 200° F (93° C); values achieved for the first three batches were respectively 207°, 198°, and 196° F (97°, 92°, and 91° C). The reaction times required to achieve the desired softening points were 12, 10, 11.5, and 7 hours respectively. The yields of oxy-activated pitch intermediate product recovered from the four batches were 90, 80, 95, and 96% respectively, these yields excluding liquid material recovered as condensate from the overhead condense. Although the softening points of the intermediate products were appropriate for electrode pitch, their coking values and benzene insolubles contents were inadequate. The intermediate pitch products were composited and used as the charge to a continuous feed heat-treating reactor of design different to that used in Example 1. It comprised a two liter stirred autoclave which was maintained substantially full during reaction, with the feed inlet at the bottom and the product outlet near the top. Constant pressure operation was achieved by a control valve capable of operating at high temperatures and which was set to open at pressure above substantially 20 atmospheres. Liquid feed was pumped into the autoclave at constant speed by a gear pump adjusted to deliver at a rate that provided the desired residence time for the feed in the autoclave. The product was discharged from the outlet to atmospheric pressure through a flash pot which acted as a gas liquid separator. To facilitate pumping of the feed to the reactor, a proportion of 10% by weight of full range decant oil was mixed with the feed, as a diluent, and a feed rate of the diluted material of 1.080 kg. per hour established to the autoclave, providing an average residence time of 1.5 hours for material in the autoclave, whose temperature was maintained at 800° F (427° C) with the pressure being maintained around 25 atmospheres. Because the liquid product from the flash pot still contained a proportion of volatile material which kept its softening point lower than desired, the accumulated liquid from the flash pot was quickly heated under vacuum (below one millimeter Hg pressure) to distill overhead 15% by weight of the material at a maximum distillation pot temperature around 380° F (193° C). The residual material from the distillation was a petroleum pitch product having a softening point of 207° F (97° C), a coking value of 44.3, a benzene insolubles content of 27.7%, and a quinoline insolubles content of 0.9%.

EXAMPLE 6

In this example the first step again was carried out in the reaction kettle described in Example 1. This time five successive batches were prepared from a full range decant oil having an initial boiling point of 465° F (240° C) and a final boiling point of 967° F (519° C) at a recovery of 86% (ASTM D1160), an API gravity of minus 4.2, and a BMCI of 140.6; the oil had an asphaltenes content of 25.9 and no benzene insoluble material. The quantity of oil charged to the kettle (kilograms) in each batch, the reactor temperature (°F and °C) at which the batch was oxy-activated, the rate of feeding air to each batch (liters/hour/kg. of feed), the duration of oxy-activation (hours) required to achieve a softening point around 200° F (93° C) for each batch, the actual softening point achieved for each batch (°F and °C), and the yield of oxy-activated intermediate product obtained as a percentage of the original batch weight are reported for the respective batches (a) to (e) in the following table:

| Batch | Weight kg. | Temp. ° F and (° C) | Air Feed l/hr/kg | Time hrs. | S. Pt. ° F and (° C) | Yield % |
|---|---|---|---|---|---|---|
| (a) | 4.20 | 450 (232) | 287 | 16.0 | 201 (94) | 87 |
| (b) | 4.21 | 450 (232) | 276 | 18.0 | 204 (96) | 95 |
| (c) | 4.35 | 450 (232) | 280 | 17.0 | 205 (96) | 91 |
| (d) | 4.20 | 415 (213) | 290 | 17.0 | 194 (90) | 82 |
| (e) | 4.20 | 460 (237) | 287 | 12.0 | 229 (109) | 85 |

As in Example 5 above, the intermediate pitch products were composited and diluted with a full range decant oil, this time in a proportion of 5% by weight, to facilitate pumping. The composited diluted material was fed continuously to the heat treating autoclave described in Example 5, at a rate of 2.70 kg. per hour. Temperature in the autoclave was held at 790° F (421° C) and pressure at substantially 24 atmospheres; with the foregoing feed rate, average residence time in the reactor was 36 minutes. Accumulated product from the flash pot then was quickly distilled under vacuum (below one millimeter Hg. pressure) to distill overhead substantially 22% of the material at a maximum distillation pot temperature around 415° F (214° C). The residual material from the distillation was a petroleum pitch product having a softening point of 204° F (96° C), a coking value of 44.8, a benzene insolubles content of 22.6% and a quinoline insolubles content of 0.3%.

Numerous properties of electrodes prepared from each of the petroleum pitch products of the foregoing Examples 3, 4, 5 and 6 were determined for both Soderberg and prebaked types of electrodes. For properties such as Binder Content, Paste Elongation, Paste Thermal Stability, Green Apparent Density, Baked Apparent Density, Volume Change on Baking, Air Permeability, Electric Resistivity, Compressive Strength, Bending Strength, Pseudo-tensile Strength, Young's Modulus, Thermal Conductivity, Coefficient of Thermal Expansion, Air Oxidation Rate, Anode Consumption, and others, the values found were held by an aluminum smelter to be acceptable for use of the pitches in aluminum potlines for the smelting of alumina.

Numerous modifications can be made in the specific expedients described without departing from the invention disclosed, the scope of which is defined in the following claims.

What is claimed is:

1. A process for the preparation of a petroleum pitch binder for the manufacture of carbon electrodes, comprising (1) subjecting a full range decant oil petroleum fraction, obtained as the clarified bottoms fraction of a catalytic gas oil cracking operation and having a boiling range at atmospheric pressure at least 95% of which is above 450° F (232° C), to oxy-activated condensation by heating at a temperature in the range from 400° to 500° F (204° to 260° C) under a pressure in the range from atmospheric to four atmospheres and with the addition of air introduced to the fraction for a period of from one to 24 hours until the softening point of the material has risen to a value in the range from 120° to 180° F, (2) thereafter heating the resulting material for a period of from 3 to 300 minutes at a temperature in the range from 775° to 975° F (413° to 524° C) under a pressure of from 15 to 30 atmospheres, and finally (3) flash distilling the heated material to separate therefrom that portion thereof which must be removed to leave the remainder as a petroleum pitch with a softening point in the range from 175° to 275° F (79° to 135° C).

2. A process as claimed in claim 1 in which the air is introduced in a proportion of at least 50 liters per hour per kilogram of fraction during the oxy-activated condensation.

3. A process as claimed in claim 2 in which the oxy-activated condensation is carried out at super-atmospheric pressure of substantially three atmospheres at a temperature of substantially 450° F (232° C) with a flow of substantially 200 liters of air per kilogram of fraction being added to the petroleum fraction until the softening point of the fraction rises to a value in the range from 120° to 180° F (49° to 82° C).

4. A process as claimed in claim 3 in which the softening point is allowed to rise to a value in the range 150° – 170° F (66° to 77° C).

5. A process as claimed in claim 4 in which the fraction is subjected to mechanical stirring during the addition of air.

6. A process as claimed in claim 1 in which, in the second step, the oxy-activated material is rapidly heated to and maintained at a temperature in the range from 910° F to 930° F (487° to 499° C) at a pressure of substantially 20 atmospheres for a period of substantially 10 minutes.

7. A process as claimed in claim 6 in which the hot material from the second step is vacuum-flash distilled to leave a residual petroleum pitch product having a softening point in the range from 200° to 250° F (93° to 121° C).

* * * * *